United States Patent [19]

Ford

[11] Patent Number: 4,547,934

[45] Date of Patent: Oct. 22, 1985

[54] CRIMPED STAPLE FIBER

[75] Inventor: Thomas J. Ford, Spartanburg, S.C.

[73] Assignee: Phillips Petroleum Company, Bartlesville, Okla.

[21] Appl. No.: 575,630

[22] Filed: Jan. 31, 1984

[51] Int. Cl.[4] ..... D01G 1/04; D02G 1/12

[52] U.S. Cl. ..... 19/0.56; 28/250; 28/266; 19/0.46

[58] Field of Search ..... 19/0.46, 0.56, 0.58, 19/0.60; 28/248, 250, 266, 267

[56] References Cited

U.S. PATENT DOCUMENTS

| | | | |
|---|---|---|---|
| 2,820,988 | 1/1958 | Wegener | 28/250 |
| 3,859,695 | 1/1975 | Erickson | 28/250 |
| 3,911,539 | 10/1975 | Hughes et al. | 28/267 |
| 3,936,917 | 2/1976 | Vermeer et al. | 28/250 |
| 3,975,807 | 8/1976 | Bramley et al. | 28/266 |
| 4,221,838 | 9/1980 | Hughes et al. | 28/267 X |

*Primary Examiner*—Louis K. Rimrodt
*Assistant Examiner*—J. L. Kravitz
*Attorney, Agent, or Firm*—S. E. Reiter

[57] ABSTRACT

Process and apparatus are provided for the preparation of crimped staple fibers. By automatically adjusting the pressure on the stuffer crimper box discharge means as a function of staple cutter speed, a crimped staple product with uniform fiber-to-fiber cohesion level is obtained.

20 Claims, 1 Drawing Figure

CRIMPED STAPLE FIBER

BACKGROUND

1. Field of the Invention

This invention relates to the production of crimped staple fiber. This invention also relates to apparatus for the production of crimped staple fiber. In another aspect, this invention relates to the production of a staple fiber with uniform fiber cohesion. In yet another aspect, this invention relates to a control process for the production of staple fiber with uniform fiber cohesion. In a further aspect, this invention relates to staple fiber with uniform crimp level and uniform fiber cohesion.

2. Description of the Prior Art

Stuffer box crimpers are well known and have been widely employed for crimping filament strands. Crimped filament strands are then frequently subjected to the action of a staple cutter to produce a crimped, staple fiber. It is desirable that a product with uniform level of crimp and especially a staple fiber with good cohesion properties that are consistent over a period of operation be obtained. Fiber cohesion can be measured by standard techniques such as for example ASTM D 2612-78. In addition uniformity of fiber crimp level and fiber-to-fiber cohesion can often be readily determined by visual inspection or handling of the product.

U.S. Pat. No. 3,859,695 describes a yarn crimping process wherein the pressure in a stuffer crimper is kept constant by sensing the pressure in the crimping chamber and adjusting the pressure on the flapper gate to maintain the desired pressure in the crimping chamber.

U.S. Pat. No. 2,820,988 discloses a process for the control of crimping pressure applied in a yarn crimping device wherein the weight of fiber moving out of the crimping device is monitored and adjusted to remain within established limits by adjusting the pressure applied to the flapper gate.

In U.S. Pat. No. 3,936,917, the pressure on the flapper gate of a stuffer crimper is adjusted in response to the position of the wad of yarn in the crimping chamber as determined by a jet of fluid directed across the exit of the crimping chamber.

U.S. Pat. No. 3,975,807 teaches the control of discharge of steam set fibers from a steam setting apparatus by means of a pressure feed-back loop in communication with the steam source. When steam pressure to the steam treating zone drops below the desired point, the flapper gate is closed to restrict the exit of fiber tow and thereby increases pressure in the steam setting apparatus.

OBJECTS OF THE INVENTION

It is an object of the present invention to provide a process and apparatus for control of fiber crimp level. It is a further object of the present invention to provide a method and apparatus useful for the preparation of crimped staple fibers. Yet another object of the present invention is to provide crimped staple fibers with uniform cohesion level.

These and other objects of my invention will become apparent from the disclosure and appended claims.

SUMMARY OF THE INVENTION

In accordance with the present invention, a process and apparatus are provided wherein the discharge regulation means on a fiber crimper box is controlled as a function of the speed of the fiber staple cutter. Staple fibers of uniform crimp level, uniform cohesion are thereby obtained.

Further, in accordance with the present invention, process and apparatus are provided for crimping and cutting feed fiber to produce staple fibers of uniform crimp level, uniform cohesion.

In accordance with another embodiment of the present invention, staple fibers with uniform cohesion level are provided.

DESCRIPTION OF THE PREFERRED EMBODIMENTS

Figure 1:
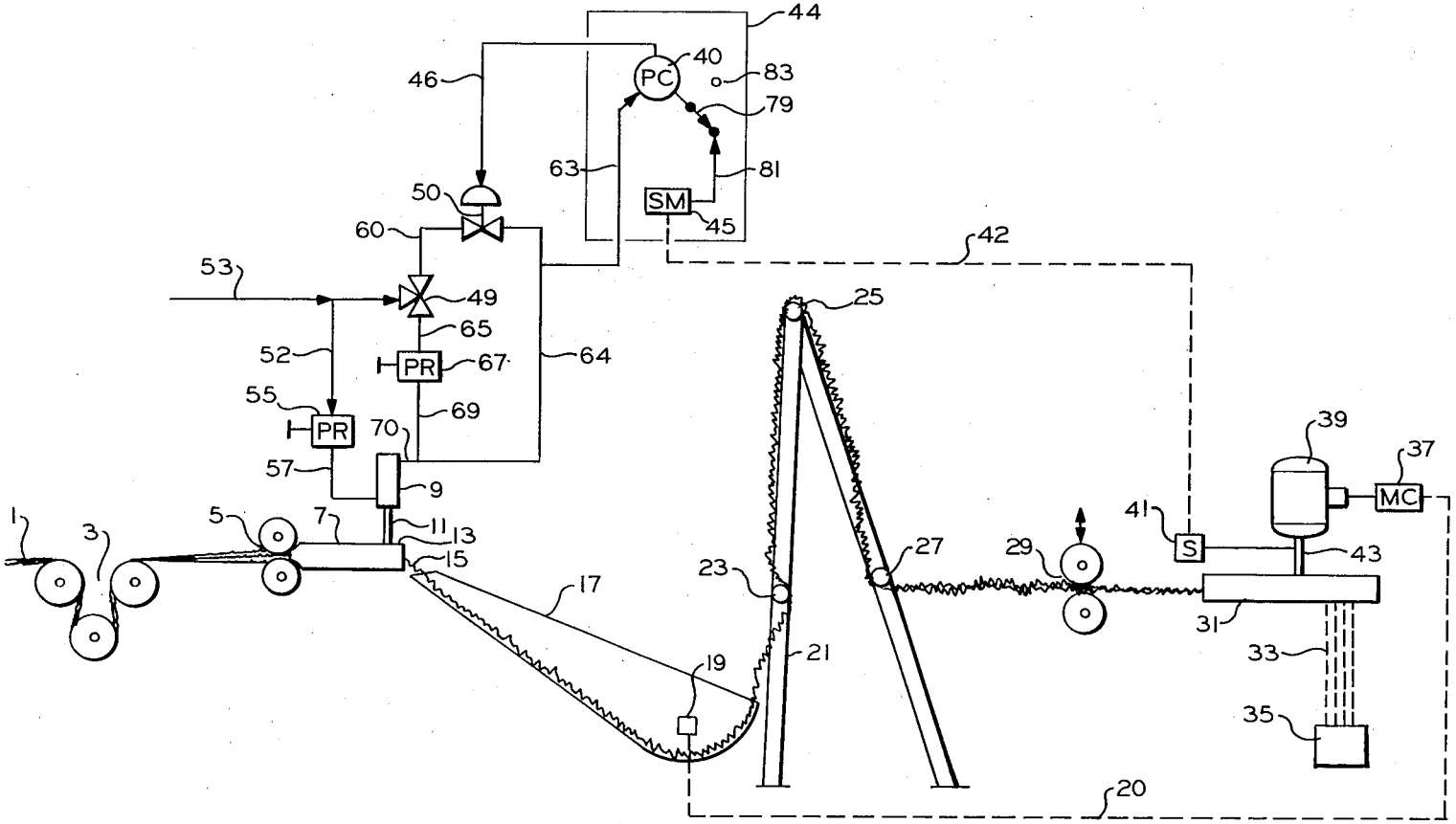
FIG. 1 is a schematic illustration of one embodiment of an apparatus of the invention.

The apparatus and process of the invention are more fully understood by reference to the drawing. There are three modes of operation possible using the apparatus shown in FIG. 1, referred to as the manual, auto-manual, and auto-automatic mode. In the manual mode, a continuous filament tow 1 can be supplied from a creel-stretching fiber line or the like (not shown) to dancer roll assembly 3 providing tension to the tow being fed to the jacketted nip rolls 5 of a crimping chamber such as for example stuffer box 7. Jacketted nip rolls 5 can be heated such as for example by steam or cooled as known in the art to crimp the continuous filament tow. Double acting air cylinder 9 provides pressure through cylinder rod 11 against discharge regulation means flapper gate 13 of stuffer box 7. In this mode of operation, the pressure is manually set by adjusting pressure regulator 67 which receives air through 3-way valve 49 and line 65. Air from pressure regulator 67 is provided to the top of the piston of double acting cylinder 9 through lines 69 and 70. Pneumatic pressure is maintained on the bottom of the piston of double-acting air cylinder 9 by manually adjusted pressure regulator 55 which receives air from lines 52 and 53 through line 57. The crimped continuous filament crimped tow 15 emerging from stuffer box 7 falls into a surge collection means such as for example a scray pin or J-box 17 which acts as a surge chamber for the supply of yarn. Crimped tow 15 then passes through tension stand 21, around rolls 23, 25 and 27 thereof, and through a pair of adjustable pneumatic nip rolls 29 adjustable by means not shown in the direction of the arrow (shown above roll 29). The adjustable pneumatic nip rolls 29 provide tension to the crimped tow 15 as it enters staple cutter 31. Staple cutter 31 cuts the crimped continuous tow into crimped staple fiber 33 which is bailed in bailer 35. Staple cutter 31 is driven by motor 39 thrugh driveshaft 43. The speed of motor 39 is controllable from about 20% above or below the set point and is controlled through line 20 by motor controller 37 and a sensor such as for example electric eye assembly 19 in relation to the amount of crimped continuous filament tow collected in J-box 17. Staple cutter 31 operates at about the set point when the intensity of the light beam impinging on the electric eye assembly 19 is reduced by about one-half, i.e., when the continuous filament tow half blocks the electric eye. When the amount of crimped continuous tow in J-box 17 which interrupts the electric eye beam 19 increases or decreases, a signal through line 20 is provided to motor controller 37 which causes the speed of motor 39 to vary proportionately from the set point. For example, if the light beam trained on the electric eye assembly 19 becomes completely blocked by continuous filament tow, the motor speed will increase by the maximum amount allowed by the system, i.e., about 20% above the set point. Conversely, if the amount of continuous filament tow in J-box 17 becomes reduced to the extent that electric eye assembly 19 is not interrupted at all, then the motor speed of cutter 31 will decrease by the maximum allowed by the system, i.e., about 20% below the set point.

It has been found by handling as well as by visual inspection of the product crimped staple prepared by the manual mode of operation that the product cohesion is variable and not uniform over a period of time, such as, for example, five minutes or longer. The filament crimp level and therefore uniformity of product staple cohesion is especially variable for about the first 30 minutes or so after cold startup of the crimper-cutter apparatus.

For the auto-manual mode of operation, three-way valve 49 is switched so that air is supplied to pressure transducer 50 from line 53 through line 60. Pressure transducer 50 converts an electrical signal from pressure controller 40 of microprocessor 44 communicated through line 46 into a pressure to be exerted on double acting cylinder 9. The electrical signal is controllable with the equipment employed herein between about 4–20 milliamperes. Pressure transducer 50 adjusts the pressure to double acting cylinder 9 through lines 64 and 70. The pressure of line 64 is in turn sensed by pressure controller 40 through line 63. Microprocessor 44 is provided with suitable push button controls such as switch 79. During the auto-manual mode of operation switch 79 is switched to position 83 and a set pressure provided to the pressure controller 40 to the top of double-acting cylinder 9. The apparatus is preferably operated in the auto-manual mode for at least about five minutes or until any excess crimped filament tow in J-box 17 is reduced to a normal level where it does not build up in the J-box.

In order to operate in the preferred auto-automatic mode of the invention, push button switch 79 is switched to position 81. Speed monitor 45 of microprocessor 44 then monitors the speed of staple cutter 31 through line 42 which provides a signal value representative of the speed of staple cutter 31 as determined for example by speed sensor 41. Monitor 45 may determine as instantaneous, average, integrated, lagged, delayed or the like value for the speed of staple cutter 31. Where an average value is employed for control purposes, speed monitor 45 monitors cutter speed for a period of time such as about 30 seconds to 1 minute or longer and then microprocessor 44 calculates an average value. This average value is provided to the pressure controller 40 which sends a signal representative of the pressure desired to be exerted on flapper gate 13 to line 46. Valve 50 converts the signal from pressure controller 40 to a pneumatic signal of between about 3–27 psi which is exerted on double acting cylinder 9 via lines 64 and 70. Microprocessor 44 illustrated in FIG. 1 can be any known means for performing the indicated functions including electrical, mechanical, hydraulic, pneumatic, or other similarly operated apparatus adapted to automatically accept the indicated input signals and generate the indicated output signals responsive thereto. Those skilled in the art are capable of implementing the method of the invention utilizing any of the various pneumatic, hydraulic, mechanical, electrical analog and digital electronic techniques available to them as well as combinations of these various techniques.

Continuous monitoring of the speed of staple cutter 31 and automatic adjustment of the pressure on double acting cylinder 9 as disclosed herein provides steady state operation wherein the crimp level of filament tow from stuffer box 7 is uniform. Adjustment for fluctuation of the numerous variables which affect the properties of product staple fiber, such as for example, total denier of filament tow passed through the stuffer-crimper apparatus, temperature of nip rolls 5, pressure on crimper box discharge gate 13, speed of staple cutter 31 and the like is carried out automatically. The need for constant human supervision in order to achieve a uniform product is thereby eliminated. In addition, continual feedback as a function of staple cutter speed and adjustment of pressure on the stuffer box discharge gate provides a means to continuously monitor and alter process conditions critical to the production of uniform staple product. It has been found that this steady state operation provided by the control system of the invention provides a crimped, staple product that exhibits uniform cohesion both by visual observation and handling.

EXAMPLE I (Control Run)

The manual mode of operation in which the pressure on the stuffer box discharge gate was adjusted manually and the speed of the cutter 31 was allowed to fluctuate according to the amount of continuous crimp filament tow in J-box 17 was conducted using a polypropylene tow of about 880,000 denier, 18 denier per filament (dpf). The filament tow was processed in a 125 millimeter Fleissner stuffer box crimper 7 having a double-acting air cylinder 9 for providing pressure on the flapper gate 13 of the stuffer box 7. The pressure on the air cylinder was manually adjusted on a pressure regulator to 15.5 psi to provide a continuous tow of crimped filaments 15 in J-box 17. The amount of material in the J-box was monitored by sensor 19 (an Auto-Lite electric eye assembly) which signaled the motor controller 37 (Reliance Automate model 31) to vary the speed of the drive motor 39 of a Lumus staple cutter 31 above or below a set point of 147 meters per minute (m/m) when the amount of tow in J-box 17 impinging on sensor 19 varied. The crimped continuous filament tow 15 was delivered to the cutter 31 through a tension stand 21 and pneumatic nip rolls 29 as shown in the drawing. The speed of the cutter was allowed by motor control 37 to vary from about 20% above or below the set point. The cohesion level of the product crimped staple fibers observed both before and after a period of about 1 hour indicated a nonuniform cohesion and crimp level by visual observation and handling of the product.

The above results indicate that variation in the temperature of the nip rolls 5 caused a change in the crimp level of the continuous filament tow 15, which in turn caused the amount of filament in J-box 17 which interrupted the beam of electric eye assembly 19 to decrease, which in turn caused variation in the speed of cutter 31. Thus, for example, as the temperature of nip rolls 5 increased, the crimp level of the filament tow 15 increased, and ultimately the cutter speed decreased. A product staple fiber resulted with nonuniform crimp and cohesion level.

EXAMPLE II (Invention Run)

A continuous polypropylene filament tow of 880,000 denier, 18 dpf, was fed to a 125 mm Fleissner stuffer box crimper 7 with a double acting air cylinder 9 for providing pressure against the flapper gate 13. Resulting crimped tow 15 of continuous filaments was passed into J-box 17 having a sensor 19 (an Auto-Lite electric eye assembly) for sensing the amount of continuous filament tow in the J-box. Crimped tow 15 was then drawn over tension stand 21 and through a pair of Lumus pneumatic nip rolls 29 to a Lumus mark IV staple cutter 31 powered by a 7½ HP Reliance motor. The cutter 31 provided staple fibers 3¼" long×18 denier useful for example, for manufacture of indoor/outdoor floor covering. The motor control 37 was a Reliance Automate 31 microprocessor. The initial speed of the staple cutter motor 39 was manually set at 147 mm. A set pressure of 15.5 psi was provided to the top of the piston of the double-acting cylinder 9 in response to a Reliance Automate Model 35 microprocessor 44. The pressure transducer 50 was a current/pneumatic pressure regulator as known in the art for converting the signal from the microprocessor 44 to a pneumatic signal which was communicated to double acting cylinder 9 via lines 64 and 70. After running for about five minutes in the auto-manual mode, the apparatus was switched to auto-automatic mode by switching push button switch 79 to position 81. The speed of the drive motor 39 for the staple cutter 31 was then averaged over about one minute time intervals by microprocessor 44 which was a Reliance Automate Model 35. As an example of the automatic adjustment made by the inventive apparatus an average cutter speed of 146.2 mm provided an electric signal via line 42 of 12.2 ma so that the pressure transducer adjusted the double acting air cylinder 9 through the 3-way valve 49 to 15.3 psi on the top of the piston. A total pressure change from the original set point of up to about 2 psi is commonly observed. Pressure on the bottom of the piston was maintained at 10 psi by regulator 55.

The product crimped staple fibers prepared by using the control system of the invention and collected from the cutter over a period of time exhibited uniform cohesion and crimp level as determined by the same methods of visual observation and handling as employed in Example I.

The results of this example demonstrate that the apparatus of this invention provides an effective means for automatically compensating for variations in process conditions such as the temperature of nip rolls 5, the speed of cutter 31 and other variables which may cause non-steady state operation of the filament crimping/cutting process. Thus, a desirable product with uniform crimp level and uniform fiber-to-fiber cohesion is obtained by employing the process and apparatus of the invention.

Although the process and apparatus of my invention have been described in detail with respect to continuous polypropylene filament tow, the scope of my invention should not be limited thereto. It is contemplated that the apparatus and process described fully above are applicable to the production of crimped staple fiber from any continuous filament tow, whether of natural or synthetic origin or a mixture of natural and synthetic materials, such as for example continuous filament tow selected from the group consisting of:

polyamides,
polyesters,
acrylonitrile polymers and copolymers,
polycarbonates,
polyurethanes,
polyester-amides,
polyolefins,
fluorinated polyolefins,
poly(arylene sulfides),
vinyl polymers and copolymers,
vinylidene polymers and copolymers,
and mixtures of any two or more thereof.

That which is claimed is:

1. A process for producing crimped staple fibers with uniform cohesion level which comprises:

(a) forcing uncrimped continuous filament tow into a crimping chamber equipped with an adjustable discharge regulation means, (b) feeding the crimped continuous filament tow produced by (a) through a staple cutter, (c) automatically adjusting the discharge regulation means in response to the speed of the staple cutter.

2. A process according to claim 1 wherein said staple cutter is equipped with a speed sensor, comprising adjusting said adjustable discharge regulation means in response to the signal from said speed sensor.

3. A process according to claim 2 further comprising averaging said signal from said speed sensor for a period of at least 30 seconds to give an averaged signal and adjusting said adjustable discharge regulation means in response to said averaged signal.

4. A process according to claim 2 comprising collecting one or more signal valves from said speed sensor, electronically averaging the signal valves from said speed sensor over a period of time, converting the averaged signal valves to a single signal, communicating said single signal to a pressure transducer, converting said single signal to a pressure valve, communicating said pressure valve to the discharge regulation means, and adjusting the discharge regulation means of said crimping chamber.

5. A process according to claim 1 further comprising passing the crimped continuous filament tow produced by (a) through a surge collection means prior to being fed to said staple cutter.

6. A process according to claim 5 wherein said surge collection means is a J-box with a sensing means therein; comprising maintaining said sensing means in operable communication with the speed control of said staple cutter and controlling the speed of said staple cutter in response to said sensing means.

7. A process according to claim 1 wherein said uncrimped continuous filament tow is selected from the group consisting of filaments of:

polyamides,
polyesters,
acrylonitrile polymers and copolymers,
polycarbonates,
polyurethanes,
polyester-amides,
polyolefins,
fluorinated polyolefins,
poly(arylene sulfides),
vinyl polymers and copolymers,
vinylidene polymers and copolymers,
and mixtures of any two or more thereof.

8. A process according to claim 7 wherein said uncrimped continuous filament tow is a continuous polypropylene filament tow.

9. The product prepared according to the process of claim 1.

10. The product prepared according to the process of claim 3.

11. The product prepared according to the process of claim 5.

12. The product prepared according to the process of claim 7.

13. The product prepared according to the process of claim 8.

14. An apparatus comprising:

(i) a crimping chamber with an inlet and an outlet means, (ii) discharge regulation means on said outlet means of said crimping chamber, (iii) staple cutter, and (iv) means to adjust said discharge regulation means (ii) in response to the speed of said staple cutter.

15. An apparatus according to claim 14 further comprising:

(v) speed sensor on said staple cutter.

16. An apparatus according to claim 14 wherein said means to adjust said discharge regulation means (ii) is in operable communication with said speed sensor on said staple cutter.

17. An apparatus according to claim 14 further comprising a surge collection means positioned between said crimping chamber (i) and said staple cutter (iii).

18. An apparatus according to claim 17 wherein said surge collection means is a J-box with a sensing means therein; and wherein said sensing means is maintained in operable communication with the speed control of the staple cutter (iii).

19. An apparatus according to claim 18 wherein said sensing means is an electric eye assembly.

20. An apparatus according to claim 17 further comprising:

(vi) a baler for collecting crimped, staple fiber.

* * * * *